United States Patent [19]

Barton, Jr.

[11] Patent Number: 4,479,857

[45] Date of Patent: Oct. 30, 1984

[54] METHOD AND APPARATUS FOR RADON CONTROL

[75] Inventor: Hugh M. Barton, Jr., Bartlesville, Okla.

[73] Assignee: Phillips Petroleum Company, Bartlesville, Okla.

[21] Appl. No.: 528,756

[22] Filed: Sep. 1, 1983

[51] Int. Cl.[3] ..... C25C 1/22

[52] U.S. Cl. ..... 204/130; 204/242; 204/275; 204/284

[58] Field of Search ..... 204/130, 100, 284, 105 R, 204/242, 275, 149

[56] References Cited

U.S. PATENT DOCUMENTS

| | | | |
|---|---|---|---|
| 636,321 | 11/1899 | Craney | 204/108 |
| 822,175 | 5/1906 | Wolcott | 204/105 R |
| 1,001,480 | 8/1911 | Sommer . | |
| 1,154,230 | 9/1915 | Bredt . | |
| 1,181,411 | 5/1916 | Schlundt . | |
| 2,118,669 | 5/1938 | Grebe | 166/21 |
| 2,761,829 | 9/1956 | Dolloff | 204/106 |
| 2,831,804 | 4/1958 | Collopy | 204/131 |
| 3,819,231 | 6/1974 | Fehlner | 204/106 |
| 3,975,674 | 8/1976 | McEuen | 324/1 |
| 4,297,574 | 10/1981 | Card et al. | 250/253 |

OTHER PUBLICATIONS

Encyclopedia of Electrochem. by Hampel, 1964, p. 838.
EMF Series, Handbook of Chem. & Physics, Chem. Rubber Co., p. 1521.

*Primary Examiner*—R. L. Andrews
*Attorney, Agent, or Firm*—French and Doescher

[57] ABSTRACT

A method of reducing the emanation of radon gas from radium in mine rock faces. Also disclosed is apparatus employing an anode in electrical contact with the mine rock face in a water-bearing formation and a cathode remote therefrom in the water-bearing formation, as well as a source of D-C voltage for applying a potential between the cathode and the anode for moving radium ions toward the cathode through the water-bearing formation from the mine rock face by electrolysis.

20 Claims, 2 Drawing Figures

METHOD AND APPARATUS FOR RADON CONTROL

Figure 1:
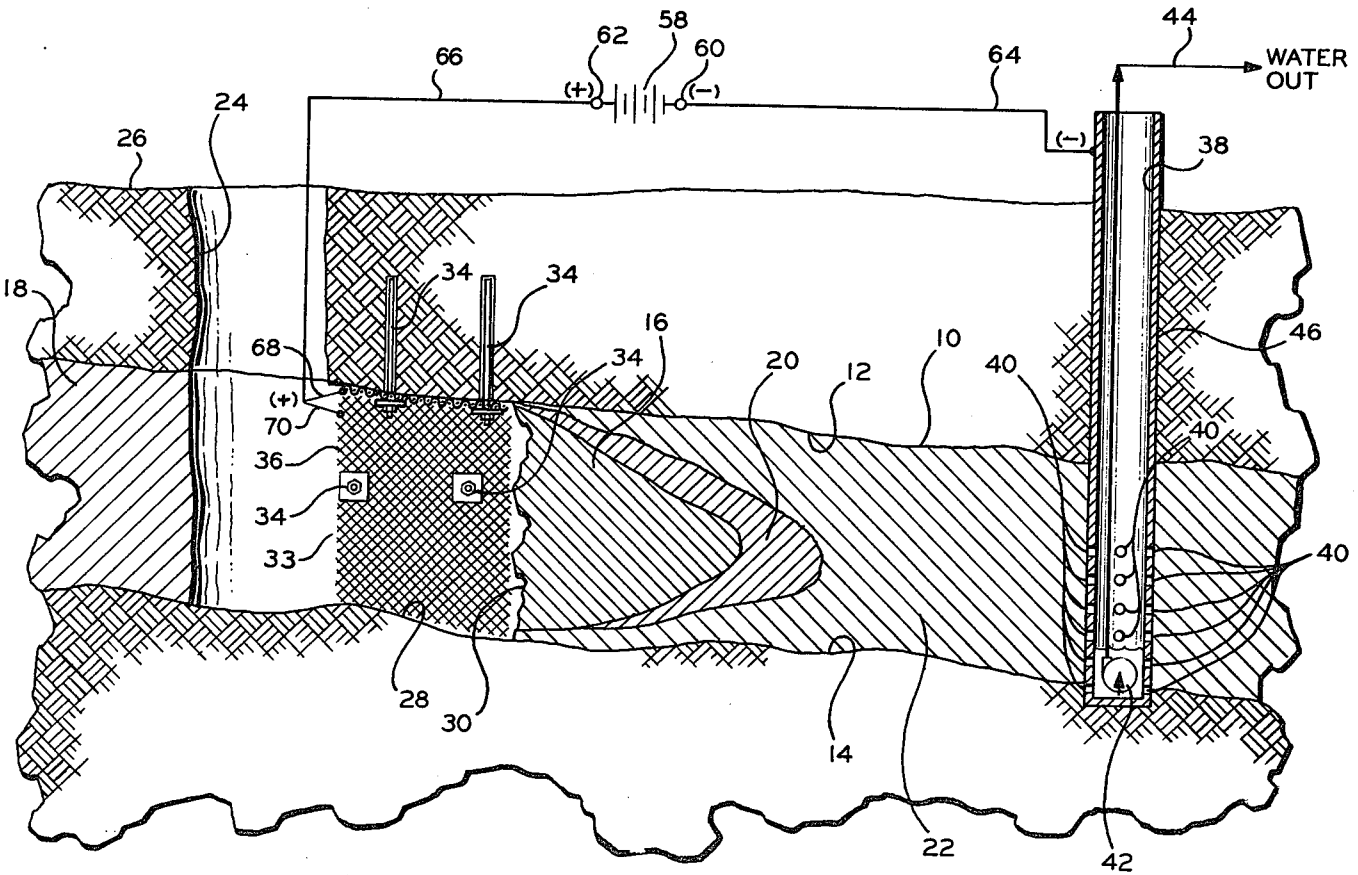

The instant invention relates generally to the reduction of the presence of radon in subterranean formations. In one aspect, the invention relates to generally to the reduction of radon in mine passages.

Radon gas is always present in uranium mines, and is frequently present in other mines. Radon is produced as the gaseous emanation from the radioactive decay of radium. Radium is a radioactive decay product of uranium and is always present in uranium-rich ore bodies. Radon and its radioactive decay products or daughters are injurious to mine workers due to their high energy heavy alpha particle emissions which can damage lung tissue when inhaled. Radon and its solid daughters or radioactive decay products diffuse or flow through cracks or pores in the rock and accumulate in the air and water in the mine as new rock is exposed. The released gaseous radon can be readily inhaled by mine workers. Similarly, the solid radon daughters can be collected on dust in the air in the mine passages and then inhaled by mine workers.

It would, therefore, be advantageous to provide method and apparatus for reducing the emanation of radon and its solid daughters from a mine rock face so as to reduce an otherwise potentially hazardous condition for mine workers.

In one aspect, the present invention contemplates a method of reducing the release of radon from a radium bearing rock face in a subterranean formation. The method includes positioning a cathode in the formation a distance from the rock face; and positioning an anode in the formation in electrical contact with at least a portion of the rock face. The method further includes applying an electrical potential between the cathode and the anode whereby radium ions are moved from the anode to the cathode through the formation thereby reducing the amount of radioactive decay of radium to radon at the rock face.

In another aspect, the present invention contemplates apparatus for reducing the release of radon from a radium-bearing mine rock face in a subterranean water-bearing formation. The apparatus includes cathode means located in the water-bearing formation a distance from the mine rock face; and anode means located in the water-bearing formation and in electrical contact with at least a portion of the mine rock face. The apparatus further includes means for developing an electrical potential between a positive terminal and a negative terminal; first electrical connecting means interconnecting the negative terminal and the cathode means; and second electrical connection means interconnecting the positive terminal and the anode means.

It is an object of the present invention to provide a method of reducing the release of radon from a radium-bearing rock face.

Another object of the present invention is to provide apparatus for reducing the release of radon from a radium-bearing rock face.

Yet another object of the invention is to provide method and apparatus for reducing the release of radon from a radium-bearing rock face which is simple, reliable and economical.

Still another object of the invention is to provide method and apparatus for reducing potentially hazardous conditions for personnel in mines.

Figure 2:
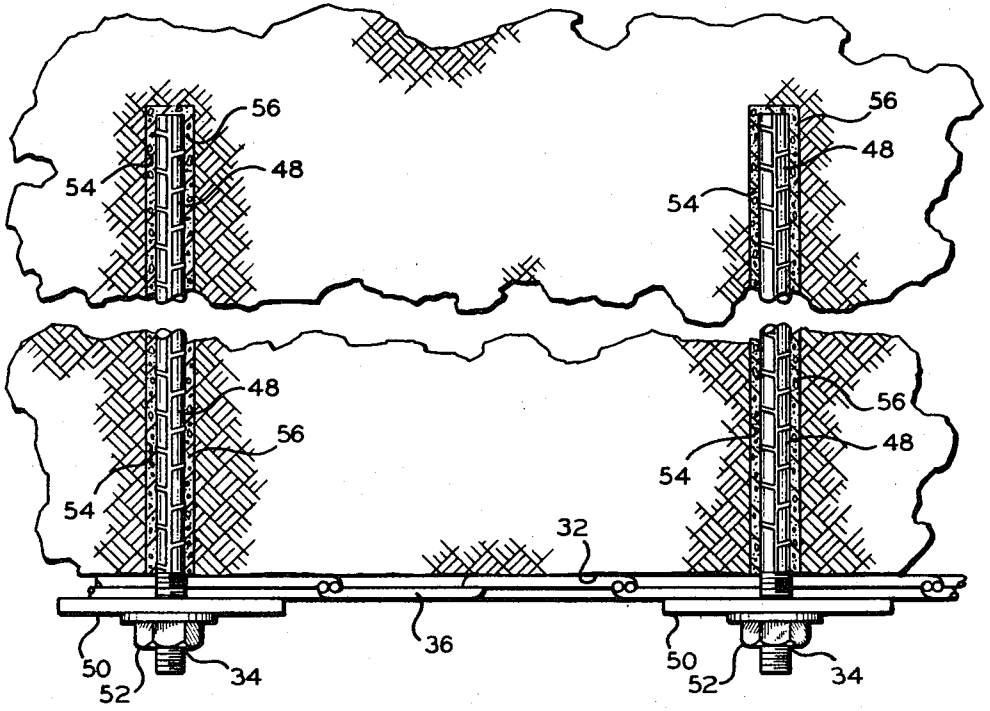

Other aspects, objects and advantages of the present invention will become apparent from the following detailed description of the present invention, the appended claims and the accompanying drawing in which:

FIG. 1 is an idealized vertical cross-sectional view of a mine illustrating the present invention; and FIG. 2 is an enlarged fragmentary view of a portion of FIG. 1 illustrating details of anchoring chainmesh screen to the mine tunnel rock face.

Referring now to the drawing, the method and apparatus of the present invention will be described in detail.

As discussed above, radon gas and its solid daughters or radioactive decay products are often present in mines in general, and are always present in mines where uranium-rich ore bodies are being mined. Radon and its radioactive decay products emanate from radium which is present in uranium-rich ore bodies.

In the present invention, radium from the mine rock face in a subterranean formation is physically removed from the vicinity of the mine rock face by electrolysis. A suitable anode is positioned in the subterranean formation in electrical contact with at least a portion of the mine rock face. A suitable cathode is positioned in the formation a distance from the mine rock face. The subterranean formations in which uranium-rich ore bodies are found are usually water-bearing formations or aquifers. The radium in such water-bearing formations is in the form of radium salts. An electrical potential of sufficient voltage is applied between the anode and the cathode placing a negative charge on the cathode and a positive charge on the anode. The radium ions of the radium salts dissolved in the water in the water-bearing formation are electrolyzed from the mine rock face through the water-bearing formation toward the cathode which is located at some suitable distance from the mine rock face.

FIGS. 1 and 2 illustrate an idealized subterranean structure, the structure being designated by the reference character 10, and being topped by a superjacent shaly bed 12 and floored by a subjacent shaly bed 14. The structure 10 is a water-bearing sandstone formation or aquifer. As illustrated in FIG. 1, the water flow through the formation or aquifer 10 is from left to right, or from updip to downdip. It will be understood that water flow can be either from updip to downdip, as illustrated, or from downdip to updip depending on the particular regional geology.

A uranium-rich ore body or deposit 16 is shown as a roll deposit in a roll front structure in the formation 10. The portion of the formation upstream or updip of the ore body 16 in formation 10 is characterized as bleached, altered sandstone and is designated by the reference character 18, and is sometimes referred to as the barren interior. Downstream or downdip of the uranium-rich ore body 16 in the formation 10 is a medium-tenor uranium ore body 20. Downstream or downdip of the medium-tenor ore body 20 is unaltered sandstone 22, sometimes referred to as protore.

A mine shaft 24 extends vertically between the earth surface 26 and the shaly bed 14. A mine tunnel 28 extends generally horizontally from the shaft 24 along the formation 10 and into the uranium-rich ore body 16, terminating at the advancing tunnel rock face 30. The roof 32 and walls 33 of the tunnel 28 are reinforced by means of suitable rockbolt systems 34, which rockbolt systems also secure a suitable chainmesh retaining screen 36 to the rock faces of the roof and walls of the tunnel. Such chainmesh is typically employed as chainlink fencing material, and, as a retaining screen, prevents rocks from falling from the roof and walls of the tunnel into the working space therebelow. The chainmesh retaining screen 36 comprises a plurality of enmeshed, electrically conductive, metallic wires.

A cased borehole 38 extends from the earth's surface 26 through the formation 10 at a suitable distance from the ore body 16, and preferably downstream or downdip of the ore body 16 in the formation 10. The cased borehole 38 is provided with suitable perforations 40 to provide fluid flow communication between the unaltered sandstone 22 and the interior of the cased borehole. The perforations 40 provide means for receiving water from the water-bearing formation 10 into the cased borehole 38. Water received in the cased borehole 38 is pumped therefrom by suitable means such as a submergible pump 42 via conduit 44. The casing 46 of the cased borehole 38 is a conventional, electrically conductive, metallic pipe. While the cased borehole 38 can be spaced any suitable distance from the advancing tunnel rock face 30 which will provide the desired water removal from the tunnel 28, such distance generally ranges from about 50 to about 300 feet or more.

The rockbolt systems 34 can be any suitable conventional metal rockbolt systems such as those described in E. Hoek et al. *Underground Excavations in Rock*, The Institution of Mining and Metrology, London, England, pp. 329–365 (1980). One such suitable rockbolt system is commonly referred to as the untensioned grouted dowel system, which is illustrated in FIG. 2 and comprises a steel dowel 48, a face plate or washer 50, and a threaded nut 52 threadedly secured to dowel. Each dowel 48 is secured within a drilled hole 54 in the rock face by means of suitable grout 56 injected into the hole 54 prior to the insertion of the dowel 48. The chainmesh retaining screen 36 is engaged by the washers 50 to secure the retaining screen to the rock face.

In the practice of the present invention, the existing chainmesh retaining screen 36 and rockbolt systems 34 can be advantageously employed as the anode, and the metallic casing pipe 46 can be advantageously employed as the cathode. A suitable D-C voltage source 58, having negative and positive terminals 60 and 62, provides the desired electrical potential between the chainmesh screen anode 36 and the metallic pipe cathode 46. Negative terminal 60 is electrically connected to the pipe cathode 46 via electrical conductor 64, and the positive terminal 62 is electrically connected to the chainmesh screen anode 36 via electrical conductors 66, 68 and 70.

It is within the scope of the invention to employ any suitable electrically conductive material as the anode in the practice of the method of the invention. Suitable anodes for such use can, for example, be constructed of magnesium or carbon or the like and can be buried or otherwise embedded in the earth near the rock face 30. In one form, the anodes can be renewable wire coils or the like of suitable metallic materials such as, for example, magnesium. While electrolytic corrosion of existing rockbolts and chainmesh screen used as the anode in the present invention is not considered to present a significant problem in the mining operation, any possible electrolytic corrosion of these elements can be effectively minimized by the use of the renewable sacrificial materials mentioned above as the anode.

In performing the method of the present invention, it is advantageous to establish the electrochemical potential required for threshold current flow in an electrolyte containing only the radium ion. Radium is similar to barium (both being Group IIA elements) which has an electrochemical potential of 2.9 volts. Therefore, a range of from about 1 to about 10 volts is assumed for radium. The earth resistance is very small, on the order of 0.1 ohms. A potential of from about 1 to about 10 volts across a 0.1 ohm resistance by the application of Ohms law requires a D-C voltage source capable of supplying a current of from about 10 to about 100 amps between the cathode 46 and the anode 36. A lower current supply may be satisfactory based on the concentration of other ions in the electrolyte, e.g., sodium which has an electrochemical potential of 2.7 volts. The application of the required current-supplying potential by the D-C voltage source 58 between the cathode 46 and the anode 36 causes the radium ions to be moved either by ion movement or in conjunction with the physical movements of other ions toward the cased water-removal borehole 38 and away from the mine rock face, thus removing the source of radon gas emanation from the mine rock face and the working area of the mine tunnel 28.

Changes may be made in the method and apparatus of the present invention without departing from the spirit and scope of the invention which is limited only by the following claims.

I claim:

1. A method of reducing the release of radon from a radium bearing rock face in a subterranean formation, comprising:

(a) positioning a cathode in said formation a distance from said rock face;

(b) positioning an anode in said formation in electrical contact with at least a portion of said rock face; and (c) applying an electrical potential between said cathode and said anode sufficient to achieve current flow between said anode and said cathode whereby radium ions are moved from said anode to said cathode through said formation thereby reducing the amount of radioactive decay of radium to radon at the rock face.

2. A method in accordance with claim 1 wherein the electrical potential of step (c) is of an amount sufficient to cause movement of radium ions from the rock face to said cathode.

3. A method in accordance with claim 1 wherein the electrical potential of step (c) is supplied at a current sufficient to cause movement of radium ions from the rock face to said cathode.

4. A method in accordance with claim 1 wherein the electrical potential of step (c) is at least substantially equal to the electrochemical potential of an electrolyte containing only positively charged radium ions.

5. A method in accordance with claim 1 wherein the electrical potential of step (c) ranges up to about 10 volts.

6. A method in accordance with claim 5 wherein said electrical potential is accomplished at a current of up to about 10 amps.

7. A method of reducing the release of radon from a mine rock face in a subterranean water bearing formation containing radium, comprising:

(a) positioning a cathode in said water bearing formation a distance from said mine rock face;

(b) positioning an anode in said water bearing formation in electrical contact with at least a portion of said mine rock face; and (c) applying an electrical potential between said cathode and said anode whereby radium ions are moved from said mine rock face adjacent said anode towards said cathode via water in said water bearing formation thereby resulting in the reduction of the amount of radioactive decay of radium to radon near said mine rock face.

8. A method in accordance with claim 7 wherein the electrical potential of step (c) ranges up to about 10 volts.

9. A method in accordance with claim 8 wherein said electrical potential is supplied at a current up to about 10 amps.

10. A method in accordance with claim 7 wherein said cathode and said anode are separated by a distance of up to about 300 feet.

11. A method in accordance with claim 7 wherein the electrical potential of said step (c) is at least substantially equal to the electrochemical potential of an electrolyte containing only positively charged radium ions.

12. A method in accordance with claim 7 wherein the electrical potential of step (c) is at least substantially equal to the electrochemical potential of the liquid electrolyte in the water bearing formation comprising positively charged radium ions.

13. A method in accordance with claim 7 characterized further to include:

(d) withdrawing liquid from said water bearing formation at a location near said cathode.

14. A method in accordance with claim 7 characterized further to include:

(d) withdrawing water and radium ions from said water bearing formation via an electrically conductive conduit in fluid flow communication with the liquid in said water bearing formation, at least a portion of said electrically conductive conduit functioning as said cathode.

15. Apparatus for reducing the release of radon from a radium bearing mine rock face in a subterranean water bearing formation, comprising:

cathode means located in said water bearing formation a distance from said mine rock face;

anode means located in said water bearing formation and in electrical contact with at least a portion of said mine rock face, said anode means comprising electrically conductive screen means fixedly secured to at least a portion of said mine rock face;

means for developing an electrical potential between a positive terminal and a negative terminal;

first electrical connection means interconnecting said negative terminal and said cathode means; and second electrical connection means interconnecting said positive terminal and said anode means.

16. Apparatus in accordance with claim 15 wherein said cathode means comprises electrically conductive conduit means extending between said water bearing formation and the surface of the earth for conducting water from said water bearing formation to the surface of the earth.

17. Apparatus in accordance with claim 16 characterized further to include pump means in fluid flow communication with said conduit means for pumping water from said water bearing formation to the surface of the earth via said conduit means.

18. Apparatus in accordance with claim 15 wherein said cathode means is located downstream from said anode means in said water bearing formation.

19. Apparatus in accordance with claim 15 wherein said anode means comprises at least one electrically conductive rigid member embedded in said mine rock face.

20. Apparatus in accordance with claim 15 wherein said electrically conductive screen means is fixedly secured to at least a portion of said mine rock face by means of at least one electrically conductive rigid member embedded in said mine rock face, said screen means and said at least one electrically conductive rigid member being in mutually electrically conductive communication.

* * * * *